United States Patent [19]

Braytenbah et al.

[11] B 3,999,390

[45] Dec. 28, 1976

[54] HTGR POWER PLANT TURBINE-GENERATOR LOAD CONTROL SYSTEM

[75] Inventors: Andrew S. Braytenbah, Pennsauken, N.J.; Karl O. Jaegtnes, Chester, Pa.

[73] Assignee: Westinghouse Electric Corporation, Pittsburgh, Pa.

[22] Filed: Apr. 25, 1974

[21] Appl. No.: 464,027

[44] Published under the second Trial Voluntary Protest Program on March 16, 1976 as document No. B 464,027.

[52] U.S. Cl. ..... 60/667; 60/658; 60/660; 60/706; 60/707

[51] Int. Cl. ..... F01k 13/02

[58] Field of Search ..... 60/658, 660–667, 60/677, 679, 706, 707; 415/17

[56] References Cited

UNITED STATES PATENTS

| | | | |
|---|---|---|---|
| 2,579,027 | 12/1951 | Walter et al. | 60/658 |
| 2,811,837 | 11/1957 | Eggenberger | 60/658 X |

*Primary Examiner*—Martin P. Schwadron
*Assistant Examiner*—Allen M. Ostrager
*Attorney, Agent, or Firm*—E. F. Possessky

[57] ABSTRACT

A control system is disclosed for a high temperature gas cooled reactor power plant, wherein a steam source derives heat from the reactor coolant gas to generate superheated and reheated steam in respective superheater and reheater sections that are included in the steam source. Each of dual turbine-generators includes a high pressure turbine to pass superheated steam and an associated intermediate low pressure turbine to pass reheated steam. A first admission valve means is connected to govern a flow of superheated steam through a high pressure turbine, and a second admission valve means is connected to govern a flow of reheated steam through an intermediate-low pressure turbine. A bypass line and bypass valve means connected therein are connected across a second admission valve means and its intermediate-low pressure turbine. The second admission valve means is positioned to govern the steam flow through the intermediate-low pressure turbine in accordance with the desired power output of the turbine-generator.

In response to the steam flow through the intermediate-low pressure turbine, the bypass valve means is positioned to govern the steam flow through the bypass line to maintain a desired minimum flow through the reheater section at times when the steam flow through the intermediate-low pressure turbine is less than such minimum. The power output of the high pressure turbine is controlled by positioning the first admission valve means in predetermined proportionality with the desired power output of the turbine-generator, thereby improving the accuracy of control of the power output of the high pressure turbine at low load levels.

40 Claims, 5 Drawing Figures

HTGR POWER PLANT TURBINE-GENERATOR LOAD CONTROL SYSTEM

CROSS REFERENCES TO RELATED APPLICATIONS

"Arrangement for Controlling the Loading of a Turbine System," Aanstad, O. J., Ser. No. 369,332, filed June 12, 1973.

"Acceleration Control Arrangement for Turbine System," Aanstad, O. J., Ser. NO. 367,991, filed June 7, 1973.

"HTGR Power Plant Hot Reheat Steam Pressure Control System," Braytenbah, A. S., and Jaegtnes, K. O., WE 45,0608, heretofore filed in the U.S. Patent Office.

BACKGROUND OF THE INVENTION

In an HTGR power plant a cooling gas (helium) is circulated through the reactor whenever the reactor operates. In an indirect cycle HTGR power plant, hot reactor cooling gas flows from the reactor to the primary sides of a plurality of steam generators which derive heat from the gas, and supply superheated and reheated steam to a turbine-generator. For desirable operation and protection of the steam generators it is necessary to maintain a minimum steam flow through the superheater and reheater sections of each steam generator. Typically, the total minimum steam flow through the steam generators is sufficient to generate 25% of maximum plant power. Therefore, bypass lines are connected across the various turbine elements to permit the total minimum steam flow through the steam generators at times when the steam flow through the turbine elements is less than such minimum.

A helium circulator is associated with each steam generator to circulate a cooling gas through the reactor and the respective steam generator. Such a circulator may be rotated by an auxiliary steam turbine. When auxiliary steam turbines are so utilized, an auxiliary turbine provided for each helium circulator uses a portion of the steam flowing to the inlet of the reheater section of the associated steam generator. The outlets of the reheater sections are commonly connected to a hot reheat header. Reheated steam may flow from the hot reheat header in three paths. A first path comprises an intercept valve and a lower pressure turbine element, a second path comprises a condenser bypass line and bypass valve means, and a third path comprises an alternate bypass line and valve means therein connected. Regulation of the hot reheat header steam pressure inproves control of the shaft speed of the auxiliary steam turbines and thus permits improved control of the flow rates of reactor coolant gas.

For purposes of loading the turbine-generator, the steam flow through the high pressure element is controlled by positioning an associated governor valve, and the steam flow through the intermediate low pressure element is controlled by positioning an associated intercept valve. Simultaneously the bypass valves connected in the bypass lines associated with the intermediate-low pressure element must be positioned to maintain the desired minimum steam flow through the reheater sections of the steam generators at times when the steam flow through the intermediate low pressure element is less than such minimum.

In a prior art system for loading a turbine-generator in a HTGR power plant, an intercept and a bypass flow valve are interlocked, whereby one valve opens as the other valve closes. Ideally, the two valves are designed to present a constant total resistance to steam flow at any interlocked position so that the steam pressure in the hot reheat header remains substantially constant under conditions of constant steam flow from the reheaters. In practice, the steam flow from the reheaters may vary, or the total resistance of the intercept and bypass valves may vary, causing variation of the hot reheat header steam pressure. In event of a turbine trip, a pressure relief valve may open to relieve excessive hot reheat header steam pressure and close thereafter at a predetermined pressure level; however, such on-off control typically permits fluctuation of the post-trip hot reheat header steam pressure, with possible deterioration of the accuracy of control of the reactor coolant gas flow rates.

In a proposed system for loading a turbine-generator in an HTGR power plant the steam flow through the high pressure element is varied to reduce a difference between a detected pressure of steam in the impulse chamber of the high pressure element and a desired value of such pressure that is in accordance with the desired power output of the turbine-generator, while the steam flow through the intermediate-low pressure element is varied to reduce a difference between a detected pressure of steam in the first stage of the intermediate pressure element and a desired value of such pressure that corresponds to the desired turbine-generator power output. While such a system satisfactorily controls the power output of the intermediate-low pressure element, the power output of the high pressure element is controlled inaccurately at low load levels (when the intercept valve is not fully opened) as the relationship between the detected impulse chamber steam pressure and the power output of the high pressure element at such load levels is nonlinear and variable with hot reheat header steam pressure. In this control system the position of the bypass valve means is varied in accordance with a signal which comprises a first component proportional to the pressure difference and a second component proportional to the time intergral of the pressure difference. Such a system operates satisfactorily in an HTGR power plant which includes a single turbine-generator. However, such a control system has certain limitations when two such control systems operate in concert, as in an HTGR power plant which includes two bypass systems and two turbine-generators, for example. When two such systems are so utilized two integrators simultaneously integrate a pressure difference signal, and the integrator output signals, which ideally are equal, frequently diverge in practice causing undesirable imbalance between the steam flows through the bypass lines.

It is desirable to provide a turbine-generator load control system which may be used in a dual turbine HTGR power plant without causing unwanted imbalances between the turbine bypass line steam flows, and which also may be used in a single turbine plant. It is also desirable to provide such a load control system that accurately controls the power output of the high pressure element at low load levels to provide such a load control system which simultaneously positions a condenser bypass valve means and an alternate bypass valve means in both a single and a dual turbine HTGR power plant. It is further desirable to operate the alternate bypass valve means to regulate the condenser bypass line steam flow at a limit which varies according to plant operating conditions. It is advantageous to provide a load control system which governs turbine bypass steam flow in response to a difference between detected and desired values of such pressure, as such a system controls the steam pressure despite variation of the steam flow through the reheaters. It is advantageous to provide a load control system which does not utilize interlocked control valves.

SUMMARY OF THE INVENTION

The present invention controls the power output of a steam turbine-generator in a high temperature gas cooled reactor power plant, wherein a steam source derives heat from the reactor coolant gas to generate superheated and reheated steam in respective superheater and reheater sections that are included in the steam source. A first admission valve means is connected to govern a flow of superheated steam through a high pressure turbine, and a second admission valve means is connected to govern a flow of reheated steam through an intermediate-low pressure turbine. A bypass line and bypass valve means connected therein are connected across the second admission valve means in the intermediate-low pressure turbine. The second admission valve means is positioned to govern the steam flow through the intermediate-low pressure turbine in accordance with the desired power output of the turbine-generator. In response to the steam flow through the intermediate-low pressure turbine, the bypass valve means is positioned to govern the steam flow through the bypass line to maintain a desired minimum flow through the reheater section at times when the steam flow through the intermediate-low pressure turbine is less than such minimum. The power output of the high pressure turbine is controlled by positioning the first admission valve means in predetermined proportionality with the desired power output of the turbine-generator, thereby improving the accuracy of control of the power output of the high pressure turbine at low load levels.

GENERAL DESCRIPTION

Figure 1:
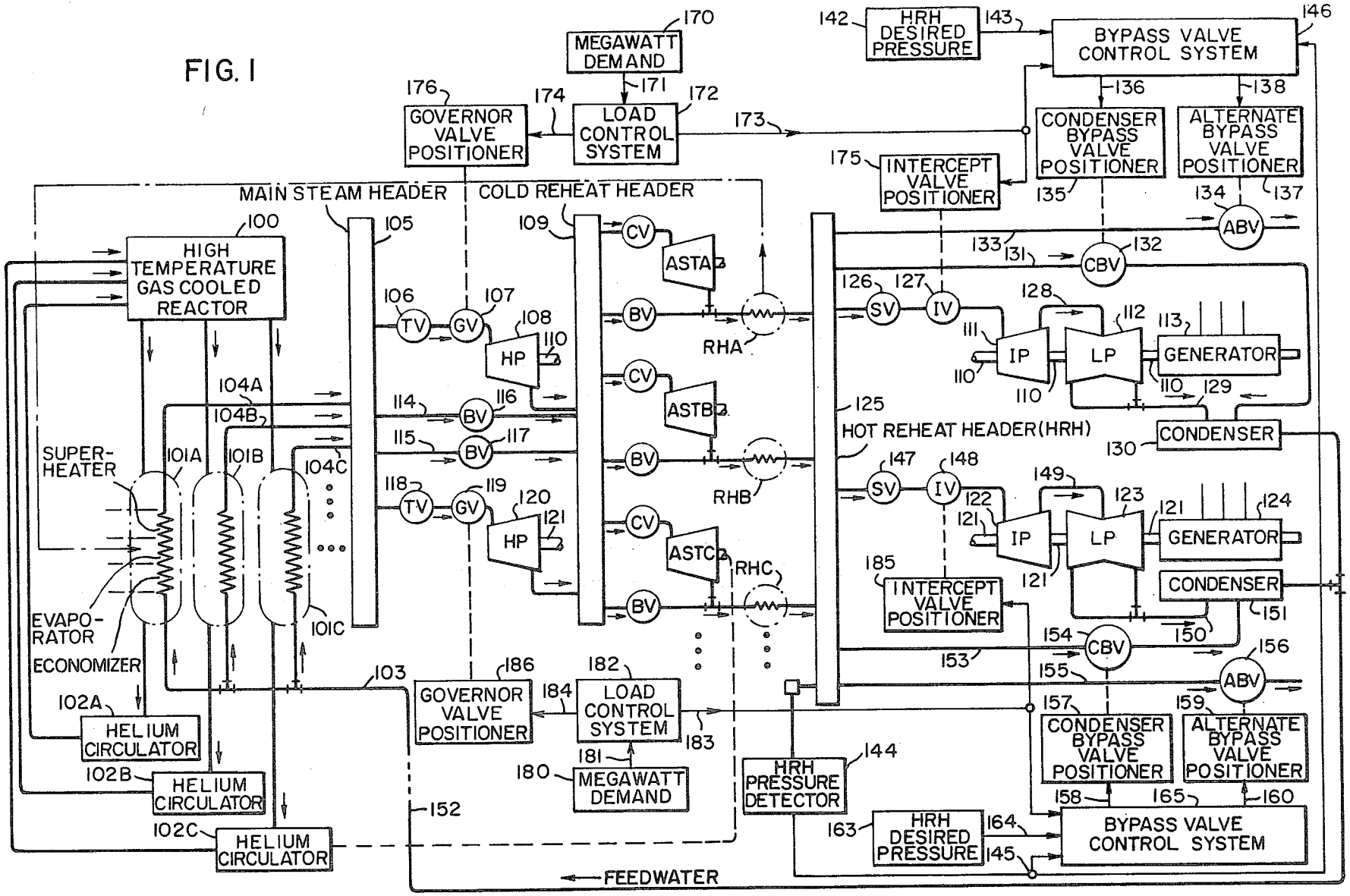
FIG. 1 is a block diagram of a dual turbine HTGR power plant which includes a hot reheat header steam pressure control system according to one embodiment of the invention.

A control system for a high temperature gas cooled reactor (HTGR) power plant is disclosed wherein such plant includes a plurality of steam generators, each deriving heat from a respective circulating flow of reactor coolant gas to supply superheated steam to a common main steam header and reheated steam to a common hot reheat header. Dual turbine-generators are connected to the common headers, a high pressure element of each turbine receiving steam from the main steam header, and an intermediate-low pressure element of each turbine receiving steam from the hot reheat header. Associated with each high pressure element is a bypass line connected between the main steam header and a cold reheat header, which is commonly connected to the high pressure element exhausts. Associated with each intermediate-low pressure element is a first bypass line connected between the hot reheat header and a respective condenser, and a second bypass line connected between the hot reheat header and an alternate steam receiving means such as a secondary condenser or atmosphere. The reactor coolant gas is circulated through each steam generator by an associated helium circulator which is rotated by an auxiliary steam turbine connected between the cold reheat header and the reheater section of the respective steam generator. The control system includes for each turbine-generator means to operate a governor valve associated with the high pressure element and an intercept valve associated with the intermediate low pressure element to control the turbine steam flows to cause the power output (load) of the respective turbine-generator to conform to a desired value thereof. At loads that exceed a predetermined load level, the governor valve is operated to regulate a detected steam pressure in the high pressure element at a desired value that is in accordance with the desired power output of the turbine-generator, the intercept valve being fully opened at such load level. At loads that are less than predetermined load levels, the governor valve is operated to vary the power output of the high pressure element in proportionality with the desired power output of the turbine-generator, while the power output of the intermediate-low pressure elements is controlled by operating the intercept valve to regulate a detected steam pressure in the intermediate pressure element at a desired value such that the combined power output of the turbine elements is equal to the desired power output. The control system governs the flow of steam through the first and second bypass lines to provide for a desired minimum steam flow through the steam generator reheater sections at times when the total steam flow through the turbines is less than such minimum, and to regulate the hot reheat header steam pressure to improve control of the auxiliary steam turbines and thereby improve control of the reactor coolant gas flow, particularly following a turbine trip. When the desired steam flow through an intermediate-low pressure turbine is less than the predetermined minimum, the control system governs the flow of steam through the first bypass line so that the combined turbine and bypass steam flow is equal to the predetermined minimum. The steam flow through the second bypass line is controlled to regulate the flow of steam through the first bypass line at a predetermined variable limit value. At times when there is a difference between detected and desired values of hot reheat header steam pressure, the control system reduces such difference by varying the steam flow through one of the bypass lines in proportion to such difference. The steam flow through the second bypass line is varied only when the flow of steam through the first bypass line is at the predetermined variable limit.

DESCRIPTION OF THE PREFERRED EMBODIMENT

Referring to FIG. 1 each of three helium circulators circulates helium coolant gas through a high temperature gas cooled reactor 100 and an associated steam generator. The steam generators 101A, 101B and 101C are associated with the helium circulators 102A, 102B and 102C respectively. Hot coolant gas is discharged from the reactor 100 and transports reactor-generated heat to each of the three steam generators. A steam generator derives heat from the reactor coolant gas flowing through it, to generate superheated and reheated steam. Feedwater is supplied to each of the steam generators through the line 103, and passes through economizer, evaporator and superheater sections in each steam generator. Superheated steam is discharged from the steam generators through the lines 104A, 104B and 104C, which conduct the superheated steam to a main steam header 105. Each steam generator also incorporates a reheater section, and utilizes reactor-generated heat to reheat a flow of steam through the incorporated reheater section. A dashed line illustrates the incorporation of a reheater section RHA in the steam generator 101A. Reheaters RHB and RHC similarly are incorporated in the steam generators 101B and 101C. Cold reactor coolant gas is discharged from a steam generator and pumped back through the reactor 100 by the associated helium circulator. It is understood that a typical HTGR power plant may employ a number different than three steam generators and associated helium circulators, depending upon the thermal generating capacity of the reactor 100. Additional steam generators would be connected to receive feedwater through the line 103 and to discharge superheated steam to the main steam header 105.

From the main steam header 105 steam may flow through a throttle valve 106 and a governor valve 107 to the inlet of a high pressure turbine 108. Exhaust steam from the high pressure turbine 108 is discharged to a cold reheat header 109. The high pressure turbine 108 turns on a shaft 110 with an intermediate pressure turbine 111, a low pressure turbine 112 and a generator 113, hereafter referred to as the "A" turbine-generator. Bypass lines 114 and 115 are connected between the main steam header 105 and the cold reheat header 109, and bypass valves 116 and 117 are connected to govern the steam flows through the lines 114 and 115 respectively. Steam also may flow from the main steam header 109 through a throttle valve 118, a governor valve 119, and a high pressure turbine 120, to the cold reheat header 109. The high pressure turbine 120 turns on a shaft 121 with an intermediate pressure turbine 122, a low pressure turbine 123, and a generator 124, hereafter referred to as the "B" turbine-generator. For most desirable steam generator operation, the steam flow through the superheater sections must be maintained at a level which is at least equal to a desired minimum steam flow. When the combined steam flow through the turbines 108 and 120 is less than the desired minimum, the bypass valves 116 and 117 are positioned to maintain the desired minimum steam flow through the superheater sections. At times when the combined steam flow through the turbines 108 and 120 exceeds the desired minimum, the valves 116 and 117 are closed. A similar desired minimum steam flow must be maintained through the reheater sections. For purposes of this discussion, the desired minimum steam flow is sufficient to generate 25% of maximum power plant output. It is understood that the power output corresponding to the desired minimum steam flow may vary, depending upon the particular design of the steam generators. It is recognized that each of the throttle valves 106 and 118 and each of the governor valves 107 and 119 corresponds to a plurality of such valves in typical practice.

An auxiliary steam turbine ASTA uses steam from the cold reheat header 109 to rotate the helium circulator 102A. Similarly auxiliary steam turbines ASTB and ASTC use steam from the cold reheat header 109 to rotate the helium circulators 102B and 102C respectively. A dashed line connecting the auxiliary steam turbine ASTC and the helium circulator 102C illustrates the rotational coupling of those elements. A control valve associated with each auxiliary steam turbine governs the steam flow through the auxiliary turbine, and thereby governs the rate of flow of reactor coolant gas through the corresponding helium circulator. Exhaust steam from the auxiliary steam turbine ASTA passes to the inlet of the reheater, RHA, and exhaust steam from the auxiliary steam turbines ASTB and ASTC similarly is discharged to the inlets of the respective reheaters RHB and RHC. A bypass line and bypass flow control valve are connected between the cold reheat header 109 and the inlet of each of the reheater sections RHA, RHB and RHC. At times when the total steam flow into the cold reheat header 109 exceeds the total steam flow through the auxiliary steam turbines, the bypass valves associated with the auxiliary steam turbines are positioned such that the bypass lines conduct the excess steam flow directly to the reheater section inlets. A hot reheat header 125 is connected to receive reheated steam from the outlets of the reheater sections. When more than three steam generators are utilized, the reheater section, the helium circulator and the auxiliary steam turbine corresponding to each additional steam generator are connected as above described.

From the hot reheat header 125 steam may flow through a stop valve 126 and an intercept valve 127 to the inlet of the intermediate pressure turbine 111. Exhaust steam from the turbine 111 flows through a line 128 to the inlet of the low pressure turbine 112. A line 129 conducts exhaust steam from the turbine 112 to a condenser 130. A condenser bypass line 131 is connected to conduct steam from the hot reheat header 125 to the condenser 130, and a condenser bypass valve 132 is connected to govern the steam flow through the line 131. An alternate bypass line 133 is connected between the hot reheat header 125 and an alternate steam receiving means, the alternate steam receiving means being atmosphere in FIG. 1. An alternate bypass valve 134 is connected to govern the steam flow through the line 133. The valve 132 is positioned by a valve positioner 135, preferably an electrohydraulic positioner which hydraulically moves the valve 132 to a position related to an electrical signal transmitted to the positioner 135 on a line 136. The valve 134 is positioned by a valve positioner 137, preferably an electrohydraulic positioner which positions the valve 134 at a position related to an electrical input signal transmitted to the positioner 137 on a line 138.

For purposes of this discussion, the stop valve 126 and the throttle valve 106 are assumed to be open, unless otherwise stated. Thus the rate of steam flow through the turbines 111 and 112 is governed by the intercept valve 127, and the rate of steam flow through the turbine 108 is governed by the governor valve 107. A device 170 generates a megawatt demand signal on a line 171 representative of a desired power output of the "A" turbine-generator. The megawatt demand signal is transmitted to a load control system 172 which generates a signal on a line 173 representative of a desired steam flow through the turbines 111 and 112 (intercept valve flow demand) and a signal on a line 174 representative of a desired position of the governor valve 107. An electrohydraulic valve positioner 175 positions the valve 127 to cause a steam flow through the turbines 111 and 112 that is effectively equal to the desired flow represented by the signal on the line 173. An electrohydraulic valve positioner 176 positions the governor valve 107 at a position represented by the signal on the line 174. As hereinafter described the load control system 172 generates the desired steam flow signal on the line 173 and the desired valve position signal on the line 174 such that the power output of the "A" turbine-generator conforms to the value represented by the megawatt demand signal on the line 171. The device 170 may be a manually set variable signal generator with an output on the line 171, or the device 170 may be a digital computer programmed to calculate a megawatt demand value that is converted by an associated digital analog converter and transmitted to the line 171. A device 142 generates an output signal on a line 143 which represents a desired value of steam pressure in the hot reheat header 125. The device 142 may be a manually set variable signal generator, with an output on the line 143 or it may be a digital computer programmed to calculate such a desired pressure value, the calculated value being converted by an associated digital to analog converter and transmitted to the line 143. A pressure transducer 144 detects the pressure of steam in the hot reheat header 125, and generates an output signal representative of the detected pressure on a line 145. A bypass valve control system 146 is responsive to the desired pressure signal on the line 143, the detected pressure signal on the line 145, and the desired steam flow signal on the line 173 to generate the valve positioner input signals on the lines 136 and 138 as hereinafter described.

Steam may flow through a stop valve 147 and an intercept valve 148 to the inlet of the intermediate pressure turbine 122. Exhaust steam from the turbine 122 flows through a line 149 to the inlet of the low pressure turbine 123. After flowing through the low pressure turbine 123, steam is conducted by a line 150 to a condenser 151. Condensed feedwater from the condensers 130 and 151 flows through a line 152 to a series of pumps and heaters (not shown). Heated and pressurized feedwater is supplied to the steam generators through the line 103.

A condenser bypass line 153 is connected between the hot reheat header 125 and the condenser 151, and a condenser bypass valve 154 is connected to govern the steam flow through the line 153. An alternate bypass line 155 is connected between the hot reheat header 125 and an alternate steam receiving means, the alternate means being atmosphere in FIG. 1. An alternate bypass valve 156 is connected to govern the steam flow through the line 155. An electrohydraulic valve positioner 157 positions the valve 154 at a position related to a signal on an input line 158. An electrohydraulic valve positioner 159 positions the valve 156 at a position related to a signal on an input line 160.

For the purposes of this discussion, it is assumed that the stop valve 147 and the throttle valve 118 are open, unless otherwise stated. Thus the rate of steam flow through the turbines 122 and 123 is governed by the intercept valve 148, and the rate of steam flow through the turbine 120 is governed by the governor valve 119. A device 180 generates a megawatt demand signal on a line 181 representative of a desired power output of the "B" turbine generator. The megawatt demand signal is transmitted to a load control system 182 which generates a signal on a line 183 representative of a desired steam flow through the turbines 122 and 123 (intercept valve flow demand) and a signal on a line 184 representative of a desired position of the governor valve 119. An electrohydraulic valve positioner 185 positions the valve 148 to cause a steam flow through the turbines 122 and 123 that is effectively equal to the desired flow represented by the signal on the line 183. An electrohydraulic valve positioner 186 positions the governor valve 119 at a position represented by the signal on the line 184. As hereinafter described the load control system 182 generates the desired steam flow signal on the line 183 and the desired valve position signal on the line 184 such that the power output of the "B" turbine-generator conforms to the value represented by the megawatt demand signal on the line 181. The device 180 may be a manually set variable signal generator with an output on the line 181, or the device 180 may be a digital computer programmed to calculate a megawatt demand value that is converted by an associated analog to digital converter and transmitted to the line 181. A device 163, which may be a manually set signal generator or a programmed digital computer with an associated digital to analog converter, generates a signal on a line 164 representative of a desired value of steam pressure in the hot reheat header 125. A bypass valve control system 165 is responsive to the detected pressure signal on the line 145, the desired pressure signal on the line 164, and the desired steam flow signal on the line 183 to generate the valve positioner input signals on the lines 158 and 160, as hereinafter described.

Although the stop valves 126 and 147 and the intercept valves 127 and 148 are illustrated as single valves in FIG. 1, it is recognized that each valve corresponds to plurality of valves in typical practice.

Figure 2:
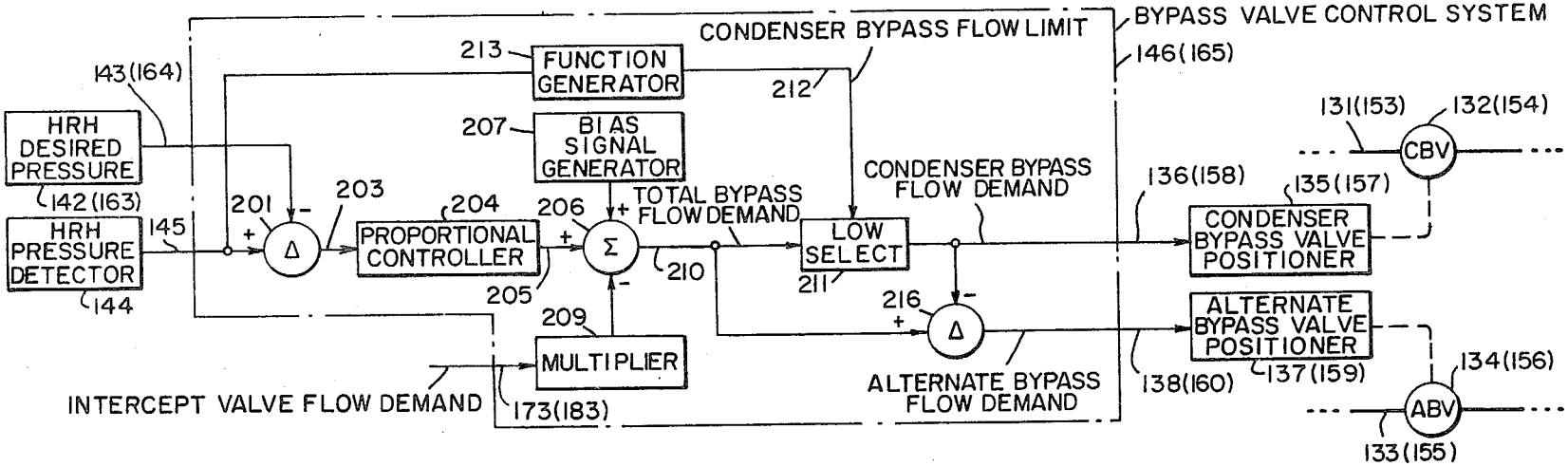
FIG. 2 is a block diagram of a bypass valve control system according to one embodiment of the invention.

Referring to FIG. 2, the bypass valve control system 146 is responsive to the intercept valve flow demand signal on the line 173 to govern the steam flows through the condenser bypass line 131 and the alternate bypass line 133 at such rates that the combined steam flow through the turbines 111 and 112 and the bypass lines 131 and 133 is equal to one-half the desired minimum steam flow through the reheater sections, at times when the steam flow through the turbines 111 and 112 is less than one-half the desired minimum. Because the desired minimum steam flow is sufficient to generate 25% maximum plant power output, it follows that one-half the desired minimum steam flow is sufficient to generate 25% maximum power output of one turbine-generator, as the maximum power capabilities of the "A" and "B" turbine-generators are equal. Thus, the steam flow through the turbines 111 and 112 is less than one-half the desired minimum at times when the "A" turbine-generator is shut down, when the "A" turbine-generator is being accelerated prior to synchronization, after synchronization, when the power output of the "A" turbine-generator is less than 25% of its maximum power output, and following a trip of the "A" turbine-generator at a power output in excess of 25% of its maximum power output. The bypass valve control system 146 also responds to a difference between the desired and detected hot reheat header steam pressure signals on the respective lines 143 and 145 to vary the steam flow through one of the bypass lines 131 and 133 to reduce such difference. Usually the bypass valve control system 146 holds the alternate bypass valve 134 closed and varies the steam flow through the condenser bypass line 133 to reduce a difference between the desired and detected pressure signals. However, the bypass valve control system 146 opens the alternate bypass valve 134 to prevent the steam flow through the condenser bypass line 131 from exceeding a corresponding flow limit. When the alternate bypass valve 134 is open, the control system 146 positions the condenser bypass valve 132 to maintain the steam flow through the condenser bypass line 131 at the limit value, and varies the steam flow through the alternate bypass line 133 to reduce a difference between the desired and detected pressure signals.

In more detail with reference to FIG. 2 the intercept valve steam flow demand signal on the line 173 is transmitted through a multiplier 209 to a first input of a summing device 206. A bias signal generator 207 generates a constant bias signal which is connected to a second input of the summing device 206. A comparator 201 generates an output signal on a line 203 which is representative of the difference between the detected pressure signal on the line 145 and the desired pressure signal on the line 143. The signal on the line 203 is transmitted to a proportional controller 204, which generates an output signal connected on a line 205 to a third input of the summing device 206. The summing device 206 subtracts the output signal of the multiplier 209 from the constant bias signal, and adds to the difference of those signals the third input signal on the line 205, to generate an output signal on a line 210. The signal on the line 210 represents total bypass steam flow demand, to be satisfied by steam flow through the condenser bypass line 131 if that flow is less than a corresponding flow limit, or by the combined steam flow through the condenser bypass line 131 and the alternate bypass line 133, otherwise.

The line 210 is connected to a first input of a low select 211. A signal representing a limit value of steam flow through the condenser bypass line 131 is generated by a function generator 213 and is transmitted by a line 212 to a second input of the low select 211. If the total bypass steam flow demand signal is less than the condenser bypass flow limit signal, the low select 211 transmits the total bypass steam flow demand signal to the valve positioner 135, which positions the condenser bypass valve 132 to cause a flow of steam through the condenser bypass line 131 effectively equal to the total bypass steam flow demand, when the steam pressure in the header 125 is at a "low load pressure value." If the total bypass steam flow demand signal exceeds the condenser bypass flow limit signal, the low select 211 transmits the condenser bypass flow limit signal to the valve positioner 135. A comparator 216 generates an output signal representing the excess of the total bypass steam flow demand over the condenser bypass flow limit, and the valve positioner 137 positions the alternate bypass valve 134 to cause a steam flow through the line 133 effectively equal to the flow represented by the output signal of the device 216. The valve positioner 135 positions the condenser bypass valve 132 to cause a flow of steam through the line 131 effectively equal to the condenser bypass flow limit. Then the combined steam flow through the lines 131 and 133 is effectively equal to the total bypass steam flow demand, when the steam pressure in the header 125 is at a "low load pressure value." The output signal of the comparator 216 is zero whenever the total bypass steam flow demand is less than the condenser bypass flow limit, and the alternate bypass valve positioner 137 then holds the alternate bypass valve 134 closed.

Each of the bypass control valves 132 and 134 is characterized by a linear relationship between valve position and steam flow through the valve at constant differential pressure across the valve. The valve positioner associated with each bypass control valve moves the respective valve to a position which is linearly related to the input signal to which the positioner responds. Bypass control valves having non-linear characteristics may be used; when such valves are used each valve positioner is modified to move the associated bypass control valve to a position which is non-linearly related to the respective valve positioner input signal, to compensate the non-linearity of the bypass control valve. A plurality of valves may be utilized to perform the function of the condenser bypass valve 132 or of the alternate bypass valve 134. In that instance a valve positioner is provided for each such valve, and the positioners operate in concert to cause a steam flow through the respective bypass line which is effectively equal to that when a single valve and associated valve positioner are used.

Provided that the detected pressure of steam in the hot reheat header 125 does not deviate from the desired value, the input and output signals of the proportional controller 204 are zero, and the total bypass steam flow demand signal is a function solely of the intercept valve steam flow demand. If the detected pressure of steam in the header 125 differs from the desired pressure, a pressure difference signal is generated by the comparator 201 and is transmitted through the proportional controller 204 to the summing device 206, which modifies the total bypass steam flow demand signal according to the output signal of the controller 204. As the bypass valves 132 and 134 are positioned to satisfy the modified total bypass steam flow demand signal, the pressure difference is reduced.

The following equation relates to the function generator 213:

$$BTU_{max} = K_1 \times F_{max} \times HRHP$$

wherein $BTU_{max}$ = maximum allowable rate of heat delivery to the condenser 130 by the condenser bypass line 131, $K_1$ = proportionality constant, $F_{max}$ = maximum steam flow through the condenser bypass line 131 corresponding to $BTU_{max}$, HRHP = hot reheat header (125) steam pressure. Hence $F_{max} = BTU_{max}/(K_1 \times HRHP)$. In the latter relationship the maximum steam flow in the condenser bypass line 131 varies inversely with the pressure of steam in the header 125. Therefore the function generator 213 is responsive to the output signal of the pressure transducer 144, which represents the detected pressure of steam in the header 125, to generate the signal on the line 212, which represents $F_{max}$, according to the above relationship.

Figure 3A:
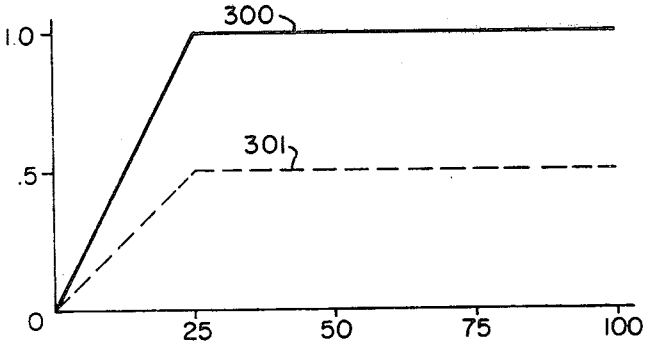
FIGS. 3A and 3B graphically illustrate certain signals generated by the bypass valve control sytem of FIG. 2.

Referring to FIG. 3A the intercept valve steam flow demand signal on the line 173 is graphically represented (line 300) in relation to the power output of the "A" turbine-generator. On the vertical axis the intercept valve steam flow demand is shown on a scale normalized between 0 and 1.0. On the horizontal axis the power output of the "A" turbine-generator is shown in percent of the maximum power output of that turbine-generator. The intercept valve steam flow demand increases from 0 to 1.0 as the power output increases from 0 to 25%. An intercept valve flow demand of 0 causes the valve positioner 175 (see FIG. 1) to close the intercept valve 127. An intercept valve flow demand of 1.0 causes the valve positioner 175 to open fully the intercept valve 127. Over the power output range 25% to 100% the intercept valve flow demand is constant at 1.0, and the valve positioner 175 holds the intercept valve 127 fully open over such power output range. Between 0 and 25% power output, the desired steam pressure in the hot reheat header 125 is regulated at a constant valve (the "low load pressure value") such that fully opening the intercept valve 127 causes a steam flow through the turbines 111 and 112 effectively equal to one-half the desired minimum steam flow through the reheater sections (see FIG. 1). As the power output of the "A" turbine-generator increases from 0 to 25%, the corresponding steam flow through the turbines 111 and 112 increases from zero to one-half the desired minimum steam flow.

Again with reference to FIG. 3A, a dashed line 301 graphically represents the output signal of the multiplier 209 (see FIG. 2) in relation to the power output of the "A" turbine-generator. The multiplier 209 multiplies the intercept valve steam flow demand signal by a constant factor of 0.5, therefore the output signal of the multiplier 209 increases in value from 0 to 0.5 as the power output increases from 0 to 25%. Above 25% power output, the output signal of the multiplier 209 is constant at 0.5.

Figure 3B:
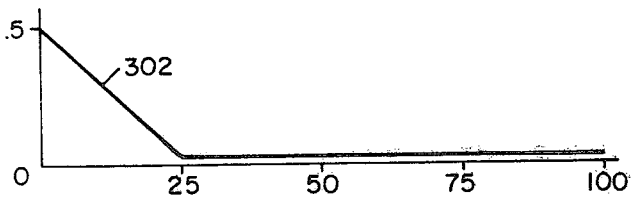

Referring now to FIG. 3B the total bypass steam flow demand signal on the line 210 (see FIG. 2) is graphically represented (line 302) in relation to the power output of the "A" turbine-generator. On the vertical axis the total bypass steam flow demand signal is shown on a scale between 0 and 0.5. On the horizontal axis the power output of the "A" turbine-generator is shown in percent. The bias signal generated by the signal generator 207 (see FIG. 2) has a constant value of 0.5 in relation to the output signal of the multiplier 209, which is represented by the dashed line 301 of FIG. 3A. Assuming that the difference between the detected and desired values of hot reheat header steam pressure is zero, the comparator 201 (see FIG. 2) generates a zero output signal on the line 203, and the signal on the line 205 accordingly is zero. Then the total bypass steam flow demand signal is generated by the summing device 206 (see FIG. 2) according to the difference between the constant bias signal of value 0.5 and the output signal of the multiplier 209. As shown in FIG. 3B the total bypass steam flow demand signal decreases from 0.5 to 0 as the power output of the "A" turbine-generator increases from 0 to 25%. Above 25% power output, the total bypass steam flow demand is constant at 0. A total bypass steam flow demand of 0.5 causes the condenser bypass valve positioner 135 to position the condenser bypass valve 132 such that the steam flow through the condenser bypass line 131 is effectively equal to one-half the desired minimum steam flow, when the pressure of steam in the hot reheat header 125 is at the "low load pressure value," and the condenser bypass flow limit is greater than one-half the desired minimum steam flow. Otherwise the valve positioners 135 and 137 position the bypass valves 132 and 134 so that the combined steam flow through the condenser bypass line 131 and the alternate bypass line 133 is effectively equal to one-half the desired minimum, when the hot reheat steam pressure is at the "low load pressure value." A total bypass steam flow demand of 0 causes the valve positioners 135 and 137 to hold the bypass valves 132 and 134 closed. Thus the combined steam flow through the bypass lines 131 and 133 decreases from one-half the desired minimum steam flow to zero, as the power output of the "A" turbine-generator increases from 0 to 25%, on the assumption that no pressure difference signal is generated by the comparator 201.

The heavy line 300 of FIG. 3A shows a linear relationship between power output and intercept valve flow demand between 0 and 25% maximum power output for purposes of clarity and simplicity of exposition, and should not be construed as a limitation. The bypass valve control system 146 is equally effective in response to a non-linear relationship between power output and intercept valve flow demand over such power output range as long as the intercept valve is fully opened at 25% maximum power output.

It is understood that values other than 0.5 may be used for the gain of the multiplier 209 and the value of the bias signal. For example, the bias signal value and the multiplier gain may each be 1.0, in which case the line 173 would be connected directly to the summing device 206 and the valve positioners 135 and 137 would be arranged to position the respective valves 132 and 134 to cause a total steam flow through the lines 131 and 133 which is effectively equal to one-half the desired minimum steam flow when the total bypass flow demand is 1.0 and the hot reheat header steam pressure is at the "low load pressure value." The value 0.5 is suitable when the condenser 135 is capable of condensing the total desired minimum steam flow at the "low load pressure value" of hot reheat steam pressure.

Over the power output range 0 to 25% the output signal of the device 142 represents a constant desired pressure equal to the "low load pressure value." From the above discussion, it is evident that over such power output range the bypass valve control system 146 governs the steam flow through the condenser bypass line 131 and the alternate bypass line 133 so that the combined steam flow through such bypass lines and the turbines 111 and 112 is effectively equal to one-half the desired minimum steam flow, assuming no difference between the detected and desired values of hot reheat header steam pressure. Between power output levels of 0 to 25% an increase of steam flow through the turbines 111 and 112 is accompanied by a corresponding decrease of steam flow through the bypass lines 131 and 133, and in effect the bypass control system 146 "transfers" bypass steam flow to the turbines 111 and 112 as the power output of the "A" turbine-generator increases, while regulating the steam pressure in the hot reheat header 125.

If a difference between the detected and desired values of hot reheat header steam pressure occurs, the bypass valve control system 146 varies the steam flow through one of the bypass lines 131 and 133 to reduce the difference. In practice such a pressure difference cannot be reduced to zero, as the controller 204 is a proportional controller and permits a residual pressure difference. However, the value of the bias signal generated by the signal generator 207 is such that the magnitude of the residual pressure difference is effectively minimized.

Between 0 and 25% maximum total plant power output the reactor 100 and the helium circulators 102A–102C are operated by controls (not shown) so that the reheater sections of the steam generators are capable of supplying the desired minimum flow of reheated steam when the hot reheat header steam pressure is at the "low load pressure value." Then the bypass valve control system 146 regulates the steam pressure in the header 125 according to the "low load pressure value" and simultaneously governs the steam flow through the bypass lines 131 and 133 so that the combination of steam flows through such lines with the steam flow through the turbines 111 and 112 effectively equals one-half the desired minimum steam flow. If the reactor 100 and the helium circulators 102A–102C are not operated to supply the desired minimum flow of reheated steam at the "low load pressure value," the bypass valve control system 146 varies the steam flow through the bypass lines 131 and 133 to regulate the steam pressure in the hot reheat header 125 according to the desired low load value, but the total steam flow through the bypass lines 131 and 133 and the turbines 111 and 112 differs from one-half the desired minimum steam flow by an amount which depends upon the operation of the reactor and helium circulators.

With reference to FIG. 2 identification numbers in parentheses refer to the bypass valve control system 165 associated with the "B" turbine-generator. The elements and connection of the bypass valve control system 165 are shown within the dashed lines in FIG. 2. The above description of the connection and operation of the bypass valve control system 146 also relates to the control system 165 provided that the numbers in parentheses are substituted for the corresponding numbers in the text, and that the expressions "turbines 122 and 123", " "B" turbine-generator", "intercept valve 148", and "valve positioner 185" are substituted respectively for the expressions "turbines 111 and 112", " "A" turbine-generator", "intercept valve 127", and "valve positioner 175".

Figure 4:
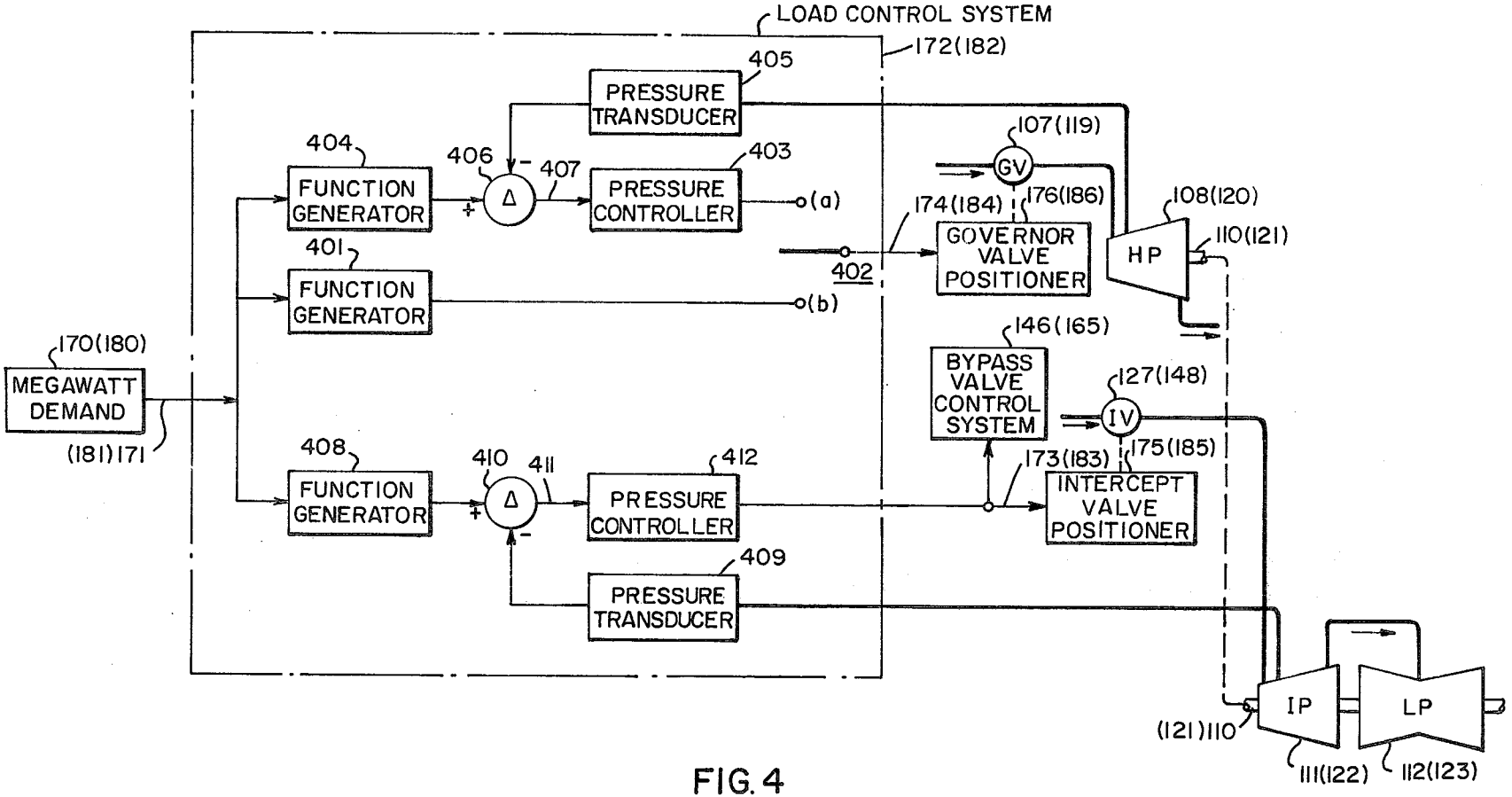
FIG. 4 is a block diagram of a load control system according to one embodiment of the invention.

With reference to FIG. 4 the load control system 172 is responsive to the megawatt demand signal on the line 171 to generate a signal on the line 174 representative of a desired position of the governor valve 107 and a signal on the line 173 representative of a desired steam flow through the turbines 111 and 112. At low loads (loads less than 25% maximum power output of the "A" turbine-generator requiring turbine steam flows that are less than one-half the desired minimum flow) a function generator 401 generates an output signal representative of a desired position of the governor valve 107 that is in accordance with the megawatt signal on the line 171. A switch 402 is placed in a position "*b*" at such low loads to transmit the desired position signal to the governor valve positioner 176, which positions the governor valve 107 at the position represented by the output signal of the function generator 401. At higher loads (loads greater than 25% maximum power output of the "A" turbine-generator requiring turbine steam flows that are greater than one-half the desired minimum flow), the switch 402 is placed in the "*a*" position to transmit the output signal of a pressure controller 403 to the governor valve positioner 176. A function generator 404 is responsive to the megawatt demand signal on the line 171 to generate an output signal that represents a desired value of steam pressure in the impulse chamber of the high pressure turbine 108 when the power output of the "A" turbine-generator is equal to the power output required by the megawatt demand signal. A pressure transducer 405 is connected to detect the pressure of steam in the impulse chamber of the high pressure turbine 108, and generates an output signal representative of the detected pressure. The output signals of the function generator 404 and the pressure transducer 405 are connnected to a comparator 406, which generates a signal on an output line 407 that represents the difference between the desired and detected values of steam pressure in the impulse chamber of the high pressure turbine 108. The line 407 is connected to the pressure controller 403, which generates an output signal that is transmitted through the switch 402 to the governor valve positioner 176. At times when there is a difference between the detected and desired values of steam pressure in the impulse chamber of the high pressure turbine 108, the pressure controller 403 varies the position of the governor valve 107 to vary the steam flow through the "A" turbine to reduce such pressure difference (as hereinafter explained, the intercept valve 127 is fully opened at such times). The pressure controller 403 preferably is a proportional plus integral type of controller wherein the controller output signal comprises the sum of a first signal that is proportional to the signal on the line 407 and a second signal that is proportional to the time integral of the signal on the line 407. When such a controller is utilized the signal on the line 407 is reduced to a steady state value of zero.

A function generator 408 is responsive to the megawatt demand signal on the line 171 to generate an output signal representative of a desired value of steam pressure in the first stage of the intermediate pressure turbine 111. A pressure transducer 409 is connected to detect the pressure of steam in the first stage of the intermediate pressure turbine 111 and generates an output signal representative of the detected pressure value. The output signal of the function generator 408 and the pressure transducer 409 are connected to a comparator 410 which generates an output signal on a line 411 that represents the difference between desired and detected values of steam pressure in the first stage of the intermediate pressure turbine 111. The pressure controller 412 generates an output signal representative of a desired steam flow (intercept valve flow demand) through the turbines 111 and 112. The desired steam flow signal is transmitted to the intercept valve positioner 175, which positions the intercept valve 127 to cause a flow of steam through the turbines 111 and 112 that is effectively equal to the desired value represented by the output signal of the pressure controller 412. The desired steam flow signal generated by the pressure controller 412 also is transmitted to the bypass valve control system 146. At times when there is a difference between the desired and detected values of steam pressure in the first stage of the intermediate pressure turbine 111, the pressure controller 412 varies the position of the intercept valve 127 to vary the flow of steam through the turbines 111 and 112 to reduce such a difference. The pressure controller 412 is of the proportional plus integral type, wherein the output signal of the controller comprises the sum of a first signal that is proportional to the signal on the line 411 and a second signal that is proportional to the time integral of the signal on the line 411. When such a controller is utilized the signal on the line 411 is reduced to a steady state value of zero.

At low loads (as previously defined) the load control system 172 simultaneously governs the steam flows through the high pressure turbine 108 and through the intermediate-low pressure turbines 111 and 112 so that the power output of the "A" turbine-generator conforms to the desired power output represented by the megawatt demand signal on the line 171. At such low load levels the switch 402 is placed in the "*b*" position, whereby the function generator 401 and the governor valve positioner 176 govern the steam flow through the high pressure turbine 108 in predetermined proportionality with the megawatt demand signal on the line 171. At low load levels the function generator 408 generates a desired value of steam pressure in the first stage of the intermediate pressure turbine 111 that is equal to the value of such pressure when the power output of the "A" turbinegenerator conforms to the value represented by the megawatt demand signal. The pressure controller 412 varies the steam flow through the turbines 111 and 112 to maintain a zero pressure difference signal on the line 411. At low loads the power output of the high pressure turbine 108 is varied in predetermined proportionality with the megawatt demand signal, while the power output of the intermediate-low pressure turbines 111 and 112 is governed in accordance with the desired value of the first stage pressure of the turbine 111, such desired value being generated by the function generator 408 in accordance with the megawatt demand signal.

As the desired power output represented by the megawatt demand signal on the line 171 increases, the load control system 172 operates the valves 107 and 127 to increase the steam flow through the high pressure turbine 108 and the intermediate low pressure turbines 111 and 112. The function generators 401 and 408 are arranged to cause equal variations of the steam flows through the high pressure turbine 108 and the intermediate low pressure turbines 111 and 112. When the megawatt demand signal on the line 171 reaches a value that requires turbine steam flows that are equal to the desired minimum flow, the intercept valve 127 is effectively fully opened, as such valve passes the desired minimum steam flow at the "low load pressure value" to which the steam pressure in the hot reheat header 125 is regulated at low load levels. The bypass valve control system 146 accordingly closes the bypass valves 132 and 134 (See FIG. 2). At megawatt demand levels that exceed the megawatt demand value that corresponds to passage of the desired minimum steam flow through the turbines comprising the "A" turbine-generator, the load control system 172 holds the intercept valve 127 fully opened, while the bypass valve control system 146 holds the bypass valves 132 and 134 closed. At such megawatt demand levels the switch 402 is placed in the "*a*" position, whereby the pressure controller 403 varies the steam flow through the turbines 108, 111 and 112 to regulate the detected value of steam pressure in the impulse chamber of the high pressure turbine 108 at a desired value of such pressure that is generated by the function generator 404 according to a predetermined relationship between the power output of the "A" turbine-generator and the steam pressure in the impulse chamber of the high pressure turbine 108. Because the function generator 404 generates the desired impulse chamber pressure in response to the megawatt demand signal on the line 171, the power output of the "A" turbine-generator is regulated according to the desired power output represented by the megawatt demand signal.

At low load levels the bypass valve 116 is operated (by means not shown) to regulate the pressure of steam in the main steam header 105 at a predetermined pressure value. As the desired power output of the "A" turbine-generator increases the steam flow through the high pressure turbine 108 increases, and the valve 116 correspondingly is operated to decrease the steam flow through the line 114. At power output levels that require a steam flow through the high pressure turbine 108 that is greater than one-half the desired minimum flow, the valve 116 is held closed.

With reference to FIG. 4 identification numbers in parentheses refer to the load control system 182 associated with the "B" turbine-generator. The above description of the connection and operation of the load control system 172 also relates to the control system 182 provided that the numbers in parentheses are substituted for the corresponding numbers in the text, and that the expressions "bypass line 115", "bypass valve 117", "bypass valve 154", "bypass valve 156", and "'B" turbine-generator' are substituted respectively for the expressions "bypass line 114", "bypass valve 116", "bypass valve 132", "bypass valve 134", and "'A" turbine-generator.'

In one mode of operation the "A" and "B" turbine-generators are loaded simultaneously (after synchronization) between 0 and 25% maximum plant power output. In this mode each of the devices 142 and 163 (See FIG. 2) generates an output signal representative of the "low load pressure value." It is understood that in the mode of operation presently being described a single device may be utilized to generate the desired hot reheat header steam pressure signal on the lines 143 and 164, and that a single comparator 201 and a single proportional controller 204 may be used to generate the signal connected to the summing devices 206 on the lines 205. As hereinafter described, other modes of operation require two of each of the devices 142, 201 and 204. The intercept valve flow demand signals on the lines 173 and 183 are simultaneously increased between 0 and 1 by the load control systems 172 and 182 in response to increasing megawatt demand signals on the lines 171 and 181 (See FIG. 4). In response, the intercept valve positioners 175 and 185 increasingly open the respective intercept valves 127 and 148 to increase the steam flows through the intermediate pressure turbines 111 and 123 in accordance with the intercept valve flow demand signals. At any intercept flow demand value between 0 and 1 the multiplier 209 (See FIG. 2) in each of the bypass valve controllers transmits the respective intercept valve flow demand signal with a gain of one-half to the summing device 206, which subtracts the multiplier output signal from the constant bias signal (assuming that the hot reheat header steam pressure is at the "low load pressure value") to generate the total bypass flow demand value which corresponds to the respective intercept valve flow demand value. The sum of the intercept valve flow demand with the total bypass flow demand is a demand steam flow equal to one-half the desired minimum steam flow through the reheaters. In each bypass valve control system, the low select passes the total bypass flow demand to the condenser bypass valve positioner, which positions the condenser bypass valve to cause a flow of steam through the condenser bypass line equal to the total bypass flow demand when such demand is less than the condenser bypass flow limit and the hot reheat header steam pressure is at the "low load pressure value." If the total bypass flow demand exceeds the condenser bypass flow limit, the low select transmits the condenser bypass flow limit to the condenser bypass valve positioner while the comparator 216 transmits the difference between the total bypass flow demand and the condenser bypass flow limit to the alternate bypass valve positioner. The condenser and alternate bypass valve positioners position the bypass valves to cause steam flows through the bypass lines in accordance with the respective valve positioner input signals, and the combined steam flow through the bypass lines is effectively equal to the total bypass flow demand when the hot reheat header steam pressure is at the "low load pressure value." When steam flow through the alternate bypass line is required to satisfy the total bypass flow demand, the condenser bypass steam flow is regulated at the corresponding flow limit, thereby minimizing the flow of steam through the alternate bypass line to atmosphere. At a desired power output between 0 and 25% maximum plant power the bypass valve control systems operate the bypass valves in concert so that the flow of steam through each bypass system (comprising one condenser bypass line and one alternate bypass line) is effectively equal to one-half the difference between desired minimum steam flow and the total steam flow through the turbines 111 and 122. Thus the bypass valve control systems operate the associated bypass valves to maintain the desired minimum steam flow through the reheaters between 0 and 25% maximum plant power, when the hot reheat header pressure is at the "low load pressure value."

If the steam generators cannot supply the desired minimum flow of reheated steam at the "low load pressure value" the comparator 201 in each bypass valve control system generates a pressure difference signal which is transmitted through the proportional controller 204 to the summing device 206, which modifies or "trims" the total bypass flow demand signal according to the controller output signal. When the bypass valves are positioned to cause a total bypass flow in accordance with the modified total bypass flow demand, the pressure difference is reduced. If the detected pressure exceeds the "low load pressure value" for example, the "trim" signal on the line 205 is positive, thereby increasing the total bypass flow demand to cause a reduction of the pressure difference when the bypass valves are positioned in response to such increased demand. The pressure detector 144, the comparator 201, and the proportional controller 204 thus comprise a pressure feedback path which "trims" the total bypass flow demand (line 302, FIG. 3B) to reduce a difference between the detected and desired values of hot reheat header steam pressure. In event that the "trimmed" total bypass flow demand signal exceeds the corresponding condenser bypass flow limit signal, the low select operates to govern the condenser bypass line flow at its corresponding flow limit, while the "trimmed" total flow demand is satisfied by alternate bypass steam flow, as heretofore described. Thus the bypass valve control systems operate their associated bypass valves in concert to vary the total bypass flow from the hot reheat header to reduce a difference between detected and desired hot reheat header steam pressure values.

When an integral mode is incorporated in each of the controllers 204, the output signals of the integrators (which ideally are equal) diverge in practice as the integrators individually integrate various disturbances which may affect one but not both of the integrators. Such divergence causes unwanted imbalance between the total bypass flow demand signals, which otherwise would be equal in the above-described simultaneous loading of dual turbine-generators. Although the hot reheat header steam pressure is effectively controlled in the presence of such imbalances, an imbalance may cause one of the total bypass flow demand signals to exceed its corresponding condenser bypass flow limit, resulting in unnecessary and unwanted discharge of steam to atmosphere. Because the controller 204 incorporates a proportional mode rather than a combination of proportional and integral modes, imbalances of the total bypass steam flow demand signals which result from integration of various disturbances are desirably eliminated. While the proportional mode controllers 204 typically permit a residual difference between the detected and desired values of hot reheat header steam pressure, such residual differences are minimized by the bias signals.

As the megawatt demand signals on the lines 171 and 181 are increased in the above examples of simultaneous loading of dual turbine generators, the intercept valves 127 and 148 are increasingly opened by the load control systems 172 and 182 (See FIG. 4) to maintain the detected steam pressure in the first stages of the intermediate pressure turbines 111 and 122 at the desired values of such pressures that are generated by the function generators 408. The desired first stage pressure values increase with increasing megawatt demand signals, and the intercept valves are increasingly opened by the pressure controller 412. Simultaneously the function generators 401 increasingly open the governor valves 176 and 186 in proportion to the increasing megawatt demand signals (the switches 402 are in the "*b*" position to transmit the output signals of the function generators 401 to the valve positioners 176 and 186). At 25% maximum plant power output the intercept valves 127 and 148 are fully opened. Correspondingly the bypass valves are increasingly closed until they are effectively fully closed at 25% maximum power output. Above 25% maximum plant power output, the pressure of the hot reheat header 125 is permitted to increase with increasing load, and the bypass valve control systems 146 and 165 are operated in the "tracking mode" wherein the devices 142 and 163 generate output signals which are identical to the output signal of the pressure detector 144. Referring to FIG. 2, "tracking mode" operation at power output in excess of 25% maximum plant power assures that the bypass valves 132, 124, 154, and 156 remain closed, because the total bypass steam flow demand (see FIG. 3B) at such power levels, in absence of a pressure difference signal on the line 203 is zero.

In the above example of simultaneous loading of dual turbine-generators, the switches 402 (see FIG. 4) are placed in the "*a*" position when the power output of each turbine-generator exceeds 25% of the maximum power output of that turbine-generator. At such power output levels, the function generators 408 generate desired first stage pressure signals such that the intercept valves 127 and 148 are held open by the pressure controllers 412. Then the pressure controllers 403 position the governor valves 107 and 119 such that the detected steam pressures in the impulse chambers of the high pressure turbines 108 and 120 are maintained equal to the desired values of such pressures that are generated by the corresponding function generators 404. As the desired impulse chamber pressures are generated in accordance with the values of those pressures that prevail when the "A" and "B" turbine-generators produce the desired power outputs represented by the respective megawatt demand signals on the lines 171 and 181, the power outputs of the turbine-generators thereby are regulated at the desired values specified by the megawatt demand signals.

Below 25% maximum power output of a turbine-generator, the power output of the intermediate-low pressure turbines is controlled by governing the steam flow through those turbines in accordance with a desired value of steam pressure in the first stage of the intermediate pressure turbine, while the power output of the high pressure turbine is controlled by varying the steam flow through such turbine in proportion to the associated megawatt demand signal, the intercept valve being partially opened at such load levels. Above 25% maximum power output the intercept valve is fully open, and the steam flow through the high and intermediate-low pressure turbines is controlled by positioning the governor valve to reduce a difference between a detected value of steam pressure in the impulse chamber of the high pressure turbine and a desired value of that pressure that is in accordance with the desired power output of the turbine-generator. At load levels that are less than 25% maximum power output it is preferred to control the power output of the high pressure turbine in proportion to the megawatt demand, as the relationship between impulse chamber steam pressure and the power output of the high pressure turbine at such load levels is both non-linear and variable with the hot reheat header steam pressure, thereby precluding accurate control of the power output of the high pressure turbine by varying the steam flow through that turbine to achieve a desired impulse chamber steam pressure value, although the power output of the intermediate-low pressure turbines is accurately controlled at such load levels by varying the steam flow through those turbines in accordance with a desired pressure of steam in the first stage of the intermediate pressure turbine. Above 25% maximum power output of a turbine-generator, the power output is accurately controlled by varying the steam flow through the turbines in accordance with a desired value of steam pressure in the impulse chamber of the high pressure turbine that corresponds to the megawatt demand.

When both turbine-generators operate and one turbine-generator is tripped the stop valve associated with the tripped turbine is closed (by controls not shown). Then only one-half of the steam flow through the reheaters is required by the operating turbine, and the remainder of the reheated steam must be bypassed in order to stabilize the hot reheat header post-trip steam pressure. In the event that each turbine-generator operated at a power output greater than 25% of its maximum output prior to the trip, the bypass valve control system associated with the operating turbine remains in the "tracking mode" in order that none of the excess reheated steam is bypassed to the condenser associated with the operating turbine. After the trip the desired pressure signal associated with the tripped turbine bypass valve control system continues to represent the hot reheat header steam pressure immediately before the trip. The megawatt demand signal associated with the tripped turbine is reduced to zero, causing the load control system associated with the tripped turbine to generate a zero intercept valve steam flow demand. The bypass valve control system associated with the tripped turbine responds to an intercept valve flow demand of zero (that value corresponding to zero output power as shown in FIG. 3A line 300) and and generates a total bypass steam flow demand of value 0.5 (assuming zero pressure difference). The low select transmits flow demand signals to one or both of the condenser and alternate bypass valve positioners as heretofore described, and the valve positioners position the bypass valves according to the valve positioner input signals to cause a flow of bypass steam effectively equal to one-half the desired minimum steam flow were the hot reheat header steam pressure at the "low load pressure value." If the resulting bypass steam flow is not effectively equal to the reheated steam flow which does not pass through the operating turbine, a difference develops between the detected and desired values of hot reheat header steam pressure, and a difference signal is generated by the comparator 201 of the bypass valve control system associated with the tripped turbine. Then the total bypass steam flow demand is "trimmed" by the summing device 206 in accordance with the output signal of the controller 204 to cause a reduction of the pressure difference when the bypass valves are positioned in response to the "trimmed" total bypass steam flow demand. The low select operates to open the alternate bypass valve only when the total bypass flow demand exceeds the condenser bypass flow limit and governs the condenser bypass flow at the flow limit at such times, to minimize the steam which is discharged to atmosphere. The post-trip steam pressure in the hot reheat header thus is stabilized at a value close to the pressure value which prevailed prior to the trip. Post-trip pressure stabilization is advantageous because the operating turbine-generator continues to generate power at its desired power output level without sudden change of the positions of the control valves associated with the operating turbine, and without transient fluctuations of the power generated by the operating turbine-generator which otherwise may result from large post-trip transient excursions of the steam pressure in the hot reheat header. Such pressure stabilization also reduces post-trip transient variation of the shaft speeds of the auxiliary steam turbines (see FIG. 1) and thereby reduces post-trip variation of the reactor coolant gas flow rates.

In event that both turbine-generators are simultaneously tripped at a power output in excess of 25% maximum power output, each of the devices 142 and 163 generates an output signal after the trip which is representative of the hot reheat header steam pressure immediately before the trip. After the trip the megawatt demand signals on the lines 171 and 181 are reset to zero to cause the load control systems 172 and 182 to generate zero intercept value flow demand signals on the lines 173 and 183. After the trip the detector 144 generates an output signal representative of the post-trip steam pressure in the hot reheat header. The bypass valve control systems 146 and 165 operate the respective bypass valves in concert to bypass the steam flow from the reheaters, and thereby regulate the hot reheat header pressure at the pre-trip pressure value. Single and dual turbine trips may occur at power output levels, below 25% maximum power output. The bypass valve control systems operate the bypass valves as above described to regulate the post-trip hot reheat header steam pressure, the difference being that the pressure is regulated at the "low load pressure value" following a trip at such lower power levels.

In another mode of operation, one turbine-generator, the "A" turbine-generator for example, may be loaded in the dual turbine power plant shown in FIG. 1. The "B" turbine-generator is shut down, and the valves 147, 154 and 156 are closed. Therefore the desired minimum steam flow through the reheaters corresponds to generation of 50% of the maximum power output of the "A" turbine-generator, as the desired minimum flow corresponds to generation of 25% of the maximum power output of each turbine-generator when both the "A" and "B" turbine-generators operate. At load levels that are less than 25% maximum power output of the "A" turbine-generator, the device 142 (see FIG. 2) generates a desired hot reheat header steam pressure signal that represents the "low load pressure value". When the megawatt demand signal on the line 171 (see FIG. 4) is 0, the corresponding intercept valve flow demand signal on the line 173 is 0. In absence of a difference between detected and desired values of hot reheat header steam pressure, the total bypass flow demand signal on the line 210 of the bypass valve control system 146 (see FIG. 2) is of the value 0.5 (see FIG. 3b) corresponding to passage of one-half the desired minimum steam flow through the bypass lines 131 and 133 (see FIG. 2). A difference develops between the detected pressure of steam in the hot reheat header 125 and the "low load pressure value", whereby the controller 204 generates an output signal of value 0.5, and the summing device 206 raises the total bypass flow demand on the line 210 of the bypass valve control system 146 to 1.0 and the valves 132 and 134 are positioned to permit passage of the desired minimum flow through the bypass lines 131 and 133.

As the megawatt demand signal on the line 171 (see FIG. 4) is increased from 0 to 25% of the maximum power output of the "A" turbine-generator, the desired hot reheat header pressure signal is constant at the "low load pressure value". As the megawatt demand signal on the line 171 increases between 0 and 25%, the load control system 172 increasingly opens the governor valve 107 and the intercept valve 127 as heretofore discussed, and at 25% maximum power output of the "A" turbine-generator, the governor valve 107 is partially opened and the intercept valve 127 is fully opened, with one-half the desired minimum flow passing through the high pressure turbine 108 and the intermediate-low pressure turbines 111 and 112. Although the intercept valve 127 is fully opened at such load level, the bypass valves 132 and 134 (see FIG. 2 are positioned by the bypass valve control system 146 to pass one-half the desired minimum steam flow through the bypass lines 131 and 133.

Between megawatt demand values of 25% and 50% of the maximum power output of the "A" turbine-generator, the desired hot reheat header steam pressure signal on the line 143 is increased from the "low load pressure value" to the hot reheat header steam pressure that corresponds to passage of the desired minimum steam flow through the turbines 111 and 112. As the megawatt demand signal increases between 25% and 50% maximum power output of the "A" turbine-generator, the load control system 172 (see FIG. 4) increasingly opens the governor valve 107 until at 50% megawatt demand, the desired minimum steam flow passes through the high pressure turbine 108. As the megawatt demand signal increases between 25% and 50% maximum power output of the "A" turbine-generator, the desired hot reheat header steam pressure signal on the line 143 (see FIG. 2) correspondingly increases to cause the steam flow through the turbines 111 and 112 to increase at the same rate as the steam flow through the high pressure turbine 108. In response, the bypass valve control system 146 operates the bypass valves 132 and 134 to decrease the steam flow through the bypass line 131 and 133, until at 50% megawatt demand the valves 132 and 134 are effectively fully closed and the steam flow through the turbines 111 and 112 is equal to the desired minimum flow.

Between megawatt demands of 50% and 100% maximum power output of the "A" turbine-generator, the load control system 172 (see FIG. 4) operates the governor valve 107 to control the power output of such turbine-generator, as heretofore described. As previously discussed the intercept valve 127 is held fully open by the load control system 172 between megawatt demand values of 25% and 100%. At megawatt demand values that exceed 50% of the power output of the "A" turbine-generator, the hot reheat header steam pressure is permitted to increase with increasing power output, and the bypass valve control system 146 (see FIG. 2) is operated in the above-described "tracking mode", thereby assuring that the bypass valves 132 and 134 remain closed.

The bypass valve control system shown in FIG. 2 also may be applied to operate the bypass valves in condenser and alternate bypass lines associated with a single full size turbine-generator. In such an application, the intercept valve passes the desired minimum steam flow through the intermediate-low pressure turbines when it is fully open and the hot reheat header steam pressure is at the "low load pressure value," and the condenser and alternate bypass valves are arranged so that either bypass line conducts the desired minimum steam flow when the value of the total bypass steam flow demand signal is 0.5 and the hot reheat header steam pressure is at the "low load pressure value." For purposes of loading the single full size turbine-generator the load control system shown in FIG. 4 may be applied to operate the governor and intercept valves. In such an application a flow of steam sufficient to generate the maximum power output of the turbine-generator passes through the turbines when the governor valve is fully opened.

The single full size turbine-generator is loaded (after synchronization) between 0 and 25% maximum power output while the hot reheat header steam pressure is controlled at the "low load pressure value." The desired hot reheat header steam pressure signal on the line 145 (see FIG. 2) represents the "low load pressure value" between the megawatt demands of 0 and 25% of maximum power output. At zero megawatt demand, the governor and intercept valves are essentially fully closed, permitting passage of a small steam flow through the turbines to maintain synchronous speed. The load control system shown in FIG. 4 generates a zero intercept valve flow demand. The bypass valve control system shown in FIG. 2 responds to the zero intercept valve flow demand to generate a total bypass flow demand of value 0.5, and the bypass valve control system positions the bypass valves such that the steam flow through the bypass lines is equal to the desired minimum flow when the hot reheat header steam pressure is at the "low load pressure value".

As the megawatt demand signal increases between 0 and 25% of the maximum power output of the turbinegenerator, the function generator 408 (see FIG. 4) correspondingly increases the desired first stage pressure of the intermediate pressure turbine. The pressure controller 412, in response to the desired and detected first stage pressure signals, increases the intercept valve flow demand signal from 0 to 1 as the megawatt demand signal correspondingly increases from 0 to 25%. The intercept valve is fully opened when the megawatt demand is equal to 25%, and the steam flow through the intermediate-low pressure turbines as such megawatt demand is equal to the desired minimum steam flow. As the megawatt demand increases from 0 to 25% the load control system increasingly opens the governor valve in proportion to the megawatt demand until at 25% megawatt demand the governor valve is partially opened and the steam flow through the high pressure turbine is equal to the desired minimum flow. The switch 402 is in the "B" position at such load levels. The details of operation of the governor and intercept valves by the load control system shown in FIG. 4 have previously been described with reference to simultaneous loading of dual turbine-generators.

As above stated, the intercept valve flow demand increases from 0 to 1 as the megawatt demand signal increases from 0 to 25%. The total bypass flow demand signal (see FIG. 3B) generated in response to the intercept valve flow demand (assuming the hot reheat header steam pressure is at the "low load pressure value") is such that the sum of the intercept valve flow demand with the total bypass flow demand is equal to the desired minimum flow. The low select 211 (see FIG. 2) transmits the total bypass flow demand signal to the condenser bypass valve positioner when the total bypass flow demand is less than the condenser bypass flow limit, otherwise the low select 211 transmits the condenser bypass flow limit signal to the condenser bypass valve positioner, while the comparator 216 transmits the difference between total bypass flow demand and the condenser bypass flow limit to the alternate bypass valve positioner. The condenser bypass valve is positioned to cause a flow effectively equal to the total bypass flow demand when the total bypass flow demand is less than the condenser bypass flow limit and the hot reheat header steam pressure is at the "low load pressure value." The alternate bypass valve is closed at such times. When the total bypass flow demand is greater than the condenser bypass flow limit, the flow through the condenser bypass line is regulated at the flow limit, while the alternate bypass valve is positioned such that the total steam flow through the condenser and alternate bypass lines equal to the total bypass flow demand when the hot reheat header steam pressure is at the "low load pressure value." Thus the steam discharge to atmosphere is minimized at times when the alternate bypass valve must be opened. At any intercept valve flow demand between 0 and 1.0, the bypass valve control system shown in FIG. 2 operates the condenser and alternate bypass valves in response to the intercept valve flow demand to cause a total steam flow through the bypass lines such that the total flow from the hot reheat header is efficiently equal to the desired minimum flow when the hot reheat header steam pressure is at the "low load pressure value."

If the steam generators cannot supply the desired minimum flow of reheated steam at the "low load pressure value" as the turbine-generator is loaded between 0 and 25% maximum power output, a pressure difference signal is generated by the comparator 201 (see FIG. 2) and the summing device 206 modifies the total bypass flow demand according to the "trim signal" generated by the proportional controller 204 on the line 205. When the condenser and alternate bypass valves are positioned in response to the modified total bypass flow demand, the difference between detected and desired values of hot reheat header steam pressure is reduced. When the alternate bypass valve is closed, the steam flow through the condenser bypass line is varied to reduce the pressure difference. When the modified total bypass flow demand exceeds the condenser bypass flow limit the steam flow through the alternate bypass line is varied to reduce the pressure difference, as the condenser bypass valve positioner input signal is constant at such times. Although the proportional controller 204 permits a residual difference between detected and desired values of hot reheat header steam pressure, the residual difference is effectively minimized by the bias signal (see FIG. 2).

At 25% maximum power output the condenser and alternate bypass valves are effectively fully closed. Above 25% maximum power output, the hot reheat header steam pressure increases with increasing load, and the bypass valve control system (see FIG. 2) is operated in the "tracking mode," wherein the detected and desired pressure signals on the respective lines 145 and 143 are equal, to ensure that the condenser and alternate bypass valves remain closed. Above 25% maximum power output, the load control system (see FIG. 4) maintains the intercept valve fully open. The switch 402 is placed in the "*a*" position at such load levels. The function generator 404 correspondingly increases the desired impulse chamber pressure of the high pressure turbine as the megawatt demand signal increases over the range 25% to 100%. The pressure controller 403 positions the governor valve to reduce a difference between desired and detected impulse chamber pressure signals, and thereby controls the steam flow through the high, intermediate and low pressure turbines in accordance with the megawatt demand signal and the corresponding desired impulse chamber pressure signal generated by the function generator 404.

After a turbine trip at a power output level in excess of 25% maximum power output, the desired pressure signal on the line 143 (see FIG. 2) continues to represent the hot reheat header steam pressure immediately before the trip. The detected pressure signal on the line 145, however, represents the hot reheat header steam pressure as a result of the trip. The stop valve associated with the intermediate-low pressure turbine is closed (by means not shown) when the turbine is tripped, and the entire flow of reheated steam to the hot reheat header must be bypassed. The post-trip intercept valve flow demand signal is 0 (see FIG. 3A), corresponding to 0 power output, and the total bypass steam flow demand (see FIG. 3B) is 0.5, assuming no pressure difference signal on the line 203 (see FIG. 2). Hence the bypass valves are positioned to cause a total bypass steam flow equal to the desired minimum steam flow were the hot reheat header steam pressure at the "low load pressure value." If the total bypass steam flow is not equal to the flow of reheated steam, a difference develops between the detected and desired values of hot reheat header steam pressure, and the comparator 201 generates a pressure difference signal on the line 203 which is transmitted through the proportional controller 204 to the summing device 206. The summing device 206 modifies the total bypass flow demand according to the output signal of the proportional controller 204 on the line 205, and the pressure difference is reduced when the condenser and alternate bypass valves are positioned in accordance with the modified total bypass flow demand. Such post-trip regulation of the hot reheat header steam pressure reduces post-trip transient variation of the shaft speeds of the auxiliary steam turbines (see FIG. 1) and thereby reduces post-trip variation of the corresponding reactor coolant gas flow rates. The bypass valve control system also operates the bypass valves to minimize variation of the hot reheat header steam pressure following a turbine trip at a power output less than 25% maximum power output, in that event, the post-trip hot reheat header steam pressure is regulated at the "load pressure value."

It should be understood that various modifications changes and variations may be made in the arrangement, operation and details of construction of the elements herein disclosed without departing from the spirit and scope of the present invention.

We claim:

1. A system for controlling the power output of a steam turbine-generator in a power plant wherein a steam source that is adapted to derive heat from a reactor coolant gas generates superheated and reheated steam in respective superheater and reheater sections, said reheater section being connected to furnish reheated steam to a hot reheat header, said coolant gas being circulated through the steam source and a high temperature nuclear reactor by a gas circulating means, driven by an auxiliary steam turbine means connected to pass at least a portion of the steam flow to the inlet of the reheater section, and said turbine including at least a high pressure turbine connected to pass superheated steam at a rate controlled by a first admission valve means and intermediate-low pressure turbine connected to pass reheated steam at a rate controlled by a second admission valve means, and wherein a bypass line and bypass valve means therein connected may conduct steam from the hot reheat header to a condensing means, said control system comprising, means to generate a first signal representative of a desired power output of the generator, means responsive to the first signal to position the second admission valve means to govern the steam flow through the intermediate-low pressure turbine in accordance with the desired power output of the generator, means responsive to the steam flow through the intermediate-low pressure turbine to position the bypass valve means to govern the steam flow through the bypass line to maintain a desired minimum flow through the reheater section at times when the flow through the intermediate-low pressure turbine is less than such minimum, and means to position the first admission valve means in predetermined proportionality with the first signal.

2. A control system according to claim 1 wherein the means to position the second admission valve means include, means responsive to the first signal to generate a second signal representative of a desired power output of the intermediate-low pressure turbine, means to generate a third signal representative of a detected power output of the intermediate-low pressure turbine, and means responsive to the second and third signals at times when the second and third signals are different to position the second admission valve means to vary the steam flow through the intermediate-low pressure turbine to reduce the difference.

3. A control system according to claim 1 wherein the third signal represents a detected value of steam pressure in the first stage of the intermediate-low pressure turbine, and the second signal represents a desired value of steam pressure in the first stage of the intermediate pressure turbine, said desired pressure value corresponding to the desired power output of the intermediate-low pressure turbine.

4. A control system according to claim 1 wherein the position of the second admission valve means is varied in accordance with the difference between the second signal and the third signal.

5. A control system according to claim 1 wherein the second admission valve means is positioned in accordance with a signal comprising the sum of a first component that is proportional to the difference between the second signal and the third signal, and a second component that is proportional to the time integral of the difference between the first signal and the second signal.

6. A control system according to claim 1 wherein the means to position the bypass valve means include, means to generate a fifth signal representative of a desired value of steam pressure in the hot reheat header that is in accordance with passage of the desired minimum flow through the reheater section, means to generate a sixth signal representative of a detected value of steam pressure in the hot reheat header, and means to vary the position of the bypass valve means in accordance with the difference between the fifth signal and the sixth signal.

7. A control system according to claim 6 wherein the means to position the bypass valve means further include, a comparator to generate an output signal representative of the difference between the fifth signal and the sixth signal, a proportional controller to generate a feedback signal having a predetermined proportionality with the output signal of the comparator, and means to vary the position of the bypass valve means in accordance with the feedback signal.

8. A control system according to claim 7 further including, means to generate a bias signal, and means to generate a signal representative of a desired position of the second admission valve means, and wherein the bypass valve means position is varied from an initial position having a predetermined relationship with the difference between the bias signal and the desired position signal.

9. A system for controlling the power output of a steam turbine-generator in a power plant wherein a steam source that is adapted to derive heat from a reactor coolant gas generates superheated and reheated steam in respective superheater and reheater sections, said reheater section being connected to supply reheated steam to a hot reheat header, said coolant gas being circulated through the steam source and a high temperature nuclear reactor by a gas circulating means, driven by an auxiliary steam turbine connected to pass at least a portion of the steam flow to the inlet of the reheater section, and said turbine including at least a high pressure turbine connected to pass superheated steam at a rate controlled by a first admission valve means and an intermediate-low pressure turbine connected to pass reheated steam at a rate controlled by a second admission valve means, and wherein a bypass line and bypass valve means therein connected may conduct steam from the hot reheat header to a condensing means, said control system comprising, means to generate a first signal representative of a desired power output of the generator, means responsive to the first signal to generate a second signal representative of a desired power output of the intermediate-low pressure turbine, means to generate a third signal representative of a detected power output of the intermediate-low pressure turbine, means responsive to the second and third signals when the second and third signals are different to position the second admission valve means to vary the steam flow through the intermediate-low pressure turbine to reduce the difference, means responsive to the steam flow through the intermediate-low pressure turbine to position the bypass valve means to govern the steam flow through the bypass line to maintain a desired minimum flow through the reheater section at times when the steam flow through the intermediate-low pressure turbine is less than such minimum, means to generate a fourth signal representative of a detected power output of the turbine-generator, means responsive to the first signal to generate a fifth signal representative of a desired power output of the turbine-generator, and means to position the first admission valve means in predetermined proportionality with the first signal at times when the steam flow through the high pressure turbine is less than the desired minimum flow, and responsive to the fourth and fifth signals at times when the steam flow through the high pressure turbine is greater than the desired minimum flow and the second admission valve means is fully opened to position the first admission valve means to vary the turbine steam flow to reduce a difference between the fourth signal and the fifth signal.

10. A control system according to claim 9 wherein the desired minimum steam flow passes through the high pressure and the intermediate-low pressure turbines when the first admission valve means is partially opened and the second admission valve means is fully opened, the bypass valve means being closed at such time, and the first valve means is further opened in response to a desired power output that exceeds the power output corresponding to passage of the desired minimum steam through the turbines.

11. A control system according to claim 9 wherein the third signal has a predetermined relationship with a detected pressure of steam in the first stage of the intermediate pressure turbine, and the fourth signal has a predetermined relationship with a detected pressure of steam in the impulse chamber of the high pressure turbine.

12. A control system according to claim 9 wherein the means to position the second admission valve means comprise, a comparator to generate an output signal representative of the difference between the second signal and the third signal, means responsive to the output signal of the comparator to generate a signal representative of a desired steam flow through the intermediate-low pressure turbine, means to position the second admission valve means in accordance with the desired steam flow signal.

13. A control system according to claim 12, wherein:

the desired steam flow signal comprises the sum of a first component that is proportional to the output signal of the comparator, and a second component that is proportional to the time integral of the output signal of the comparator.

14. A control system according to claim 9 wherein the means to position the bypass valve means comprise, means to generate a sixth signal representative of desired pressure value of steam in the hot reheat header, said desired pressure value being in accordance with passage of the desired minimum steam flow through the reheater section, means to generate a seventh signal representative of a detected value of steam pressure in the hot reheat header, and means to vary the position of the bypass valve means in accordance with the difference between the sixth signal and the seventh signal.

15. A control system according to claim 14 wherein the position of the bypass valve means is varied in predetermined proportionality with the difference between the sixth signal and the seventh signal.

16. A control system according to claim 14 further comprising, means to generate a bias signal, and means to generate a signal representative of a desired position of the second admission valve means, and wherein the position of the bypass valve means is varied from an initial position having a predetermined relationship with the difference between the bias signal and the desired position signal.

17. A control system according to claim 9 wherein the means to position the first admission valve means include, means to position the first admission valve means in accordance with an input signal representative of a desired position of the first admission valve means, means to generate a sixth signal representative of a desired position of the first valve means that is in predetermined proportionality with the first signal at times when the steam flow through the high pressure turbine is less than the desired minimum flow, a comparator to generate an output signal representative of the difference between the fourth signal and the fifth signal, means to generate a seventh signal representative of a desired position of the first admission valve means that is in accordance with the output signal of the comparator, and switching means to transmit the sixth signal to the input of the means to position the first admission valve means at times when the steam flow through the high pressure turbine is less than the desired minimum flow, and to transmit the seventh signal to the input of the means to position the first admission valve means at times when the steam flow through the high pressure turbine exceeds the desired minimum flow.

18. A control system according to claim 17 wherein the seventh signal comprises the sum of a first component that is proportional to the output signal of the comparator and a second component that is proportional to the time integral of the output signal of the comparator.

19. A control system according to claim 17, wherein:

the means to generate the sixth signal is a function generator having the first signal as an input signal.

20. A system for controlling the power output of a steam turbine-generator in a power plant wherein a steam source that is adapted to derive heat from a reactor coolant gas generates superheated and reheated steam in respective superheater and reheater sections, said reheater section being connected to supply reheated steam to a hot reheater header, said coolant gas being circulated through the steam source and a high temperature nuclear reactor by a gas circulating means driven by an auxiliary steam turbine means connected to pass at least a portion of the steam flow to the inlet of the reheater section, and said steam turbine including at least a high pressure turbine connected to pass superheated steam at a rate controlled by a first admission valve means and an intermediate-low pressure turbine connected to pass reheated steam at a rate controlled by a second admission valve means, and wherein a first bypass line and a first bypass valve means therein connected may pass steam from the hot reheat header to a condensing means, and a second bypass line and a second bypass valve means therein connected may pass steam from the hot reheat header to an alternate steam discharge means, said control system comprising, means to generate a first signal representative of a desired power output of the generator, means responsive to the first signal to position the first admission valve means to govern the steam flow through the high pressure turbine in accordance with the desired power output of the generator, means responsive to the first signal to position the second admission valve means to govern the steam flow through the intermediate-low pressure turbine in accordance with the desired power output of the generator, and means responsive to the steam flow through the intermediate-low pressure turbine to position the first and second bypass valve means to govern the steam flow through the first and second bypass lines to maintain a steam flow through the reheater section that is equal to a desired minimum flow at times when the steam flow through the intermediate-low pressure turbine is less than such minimum.

21. A control system according to claim 20 wherein the means to position the first and second bypass valve means include means to generate a signal representative of a limit value of steam flow to the first bypass line, the second bypass valve means being closed at times when the total desired steam flow through the first and second bypass lines is less than the limit value.

22. A control system according to claim 21 wherein the second bypass valve means is opened at times when the total desired steam flow through the first and second bypass lines exceeds the limit value, the first valve means being positioned to cause a steam flow through the first bypass line that is equal to the limit value at times when the second bypass valve means is opened.

23. A control system according to claim 20 wherein the desired minimum steam flow passes through the intermediate-low pressure turbine when the second admission valve means is fully opened.

24. A control system according to claim 20 wherein the steam flow through the high pressure turbine and the intermediate-low pressure turbine are each equal to the desired minimum flow then the first admission valve means is partially opened and the second admission valve means is fully opened, the first and second bypass valve means being closed at such time, and wherein the first admission valve means is further opened in response to a desired power output that exceeds the power output corresponding to passage of the desired minimum steam flow through the turbines.

25. A control system according to claim 20 wherein the means to position the second admission valve means include, means to generate a second signal representative of a detected power output of the intermediate-low pressure turbine, means responsive to the first signal to generate a third signal representative of a desired power output of the intermediate-low pressure turbine, and means responsive to the second and third signals at times when the second and third signals are different to position the second admission valve means to vary the steam flow through the intermediate-low pressure turbine to reduce the difference.

26. A control system according to claim 25 wherein the means responsive to the second and third signals include, a comparator to generate an output signal representative of the difference between the second signal and the third signal, means responsive to the output signal of the comparator to generate a signal representative of a desired steam flow through the intermediate-low pressure turbine, and means to position the second admission valve means in accordance with the desired steam flow signal.

27. A control system according to claim 26 wherein the signal representative of the desired steam flow through the intermediate-low pressure turbine comprises the sum of a first component that is proportional to the output signal of the comparator and a second component that is proportional to the time integral of the output signal of the comparator.

28. A control system according to claim 25 wherein the means to position the first admission valve means comprise, means to generate a fourth signal representative of a detected power output of the turbine, means responsive to the first signal to generate a fifth signal representative of a desired power output of the turbine, and means to position the first admission valve means in predetermined proportionality with the first signal at times when the steam flow through the high pressure turbine is less than the desired minimum steam flow, and responsive to the fourth and fifth signals at times when the steam flow through the high pressure turbine exceeds the desired minimum flow to position the first admission valve means to vary the steam flow through the turbine to reduce a difference between the fourth signal and the fifth signal.

29. A control system according to claim 28 wherein the second admission valve means is fully opened when the desired minimum steam flow passes through the high pressure turbine and the intermediate-low pressure turbine.

30. A system for controlling the power output of first and second steam turbine-generators in a power plant wherein a steam source that is adapted to derive heat from a reactor coolant gas supplies superheated steam to a main steam header and reheated steam to a hot reheat header, each of said first and second turbine-generators including at least a high pressure turbine connected to pass superheated steam from the main steam header at a rate controlled by a respective one of first and second governor valve means and an intermediate-low pressure turbine connected to pass reheated steam from the hot reheat header at a rate controlled by a respective one of first and second intercept valve means, said coolant gas being circulated through the steam source and a high temperature nuclear reactor by a gas circulating means driven by an auxiliary steam turbine means connected to pass at least a portion of the steam flow to the reheating section of the steam source, and wherein first and second bypass lines are connected between the hot reheat header and condensing means with first and second bypass valve means being connected in the respective first and second bypass lines to control the steam flows therein, said control system comprising, means to generate a first signal representative of a desired power output of the first turbine-generator, means to generate a second signal representative of a desired power output of the second turbine-generator, means responsive to the first signal to position the first governor valve means and the first intercept valve means to govern the steam flow through the first high pressure turbine and the first intermediate-low pressure turbine in accordance with the desired power output of the first turbine-generator, means responsive to the second signal to position the second governor valve means and the second intercept valve means to govern the steam flows through the second high pressure turbine and the second intermediate-low pressure turbine in accordance with the desired power output of the second turbine-generator, and means responsive to the steam flows through the first and second intermediate-low pressure turbines to position the first and second bypass valve means to govern the steam flows through the first and second bypass lines to maintain a desired minimum steam flow through the reheating section at times when the total steam flow through the first and second intermediate-low pressure turbines is less than such minimum.

31. A control system according to claim 30 wherein the means to position the first and second bypass valve means include, means to generate a third signal representative of a desired pressure of steam in the hot reheat header, said desired pressure being in accordance with passage of the desired minimum steam flow through the reheating section, means to generate a fourth signal representative of a detected pressure of steam in the hot reheat header, and means responsive to the third and fourth signals when the third and fourth signals are different to position the first and second bypass valve means to reduce the difference.

32. A control system according to claim 31 wherein the means responsive to the third and fourth signals include, a comparator to generate an output signal representative of the difference between the third signal and the fourth signal, a controller to generate an output signal having a predetermined relationship with the output signal of the comparator, and means to position the first and second bypass valve means at least in response to the output signal of the controller.

33. A control system according to claim 32 wherein the means to position the first governor valve means and the first intercept valve means include means to generate a fifth signal representative of a desired steam flow through the first intermediate-low pressure turbine, and the means to position the second governor valve means and the second intercept valve means includes means to generate a sixth signal representative of a desired steam flow through the second intermediate-low pressure turbine, and wherein the bypass valve positioning means position the first bypass valve means at an initial position that is inversely related to the fifth signal and position the second bypass valve means at an initial position that is inversely related to the sixth signal, the position of each of said first and second bypass valve means being varied from its initial value in accordance with the output signal of the controller.

34. A control system according to claim 33 wherein the output signal of the controller comprises the sum of a first component that is proportional to the output signal of the comparator and a second component that is proportional to the time integral of the output signal of the comparator.

35. A control system according to claim 33 wherein the output signal of the controller is proportional to the output signal of the comparator, and further comprising means to generate a bias signal, the initial position of the first bypass valve means being proportional to the difference between the bias signal and the fifth signal, and the initial position of the second bypass valve means being proportional to the difference between the bias signal and the sixth signal.

36. A control system according to claim 30 wherein the means to position the first and second bypass valve means include, means to generate a third signal representative of a desired pressure of steam in the hot reheat header, said desired pressure being in accordance with passage of the desired minimum steam flow through the reheating section, means to generate a fourth signal representative of a detected pressure of steam in the hot reheat header, means to generate a fifth signal that is proportional to the difference between the third signal and the fourth signal, means to generate a sixth signal that is proportional to the difference between the third signal and the fourth signal, means to position the first bypass valve means in accordance with the fifth signal, and means to position the second bypass valve means in accordance with the sixth signal.

37. A control system according to claim 36 wherein the means to position the first governor valve means and the first intercept valve means include means to generate a seventh signal representative of a desired steam flow through the first intermediate-low pressure turbine, and the means to position the second governor valve means and the second intercept valve means include means to generate an eighth signal representative of a desired steam flow through the second intermediate-low pressure turbine, and wherein the means to position the first bypass valve means positions said valve means at an initial position that is inversely related to the seventh signal, and the means to position the second bypass valve means positions said valve means at a position that is inversely related to the eighth signal, the position of the first bypass valve means being varied from its initial value in accordance with the fifth signal, and the position of the second bypass valve means being varied from its initial value in accordance with the sixth signal.

38. A control system according to claim 37 further including means to generate a first bias signal and means to generate a second bias signal, and wherein the initial position of the first bypass valve means is proportional to the difference between the first bias signal and the seventh signal, and the initial position of the second bypass valve means is proportional to the difference between the second bias signal and the eighth signal.

39. A control system according to claim 30 wherein each of said means to position a governor valve means and an intercept valve means includes, means responsive to the desired turbine-generator power output signal to generate a signal representative of a desired power output of the respective intermediate-low pressure turbine, means to generate a signal representative of a detected power output of the respective intermediate-low pressure turbine, means responsive to the detected and desired intermediate-low pressure turbine power output signals when said signals are different to position the respective intercept valve means to vary the steam flow through the intermediate-low pressure turbine to reduce the difference, means responsive to the desired turbine-generator power output signal to generate a signal representative of a desired power output of the turbine, means to generate a signal representative of a detected power output of the turbine, and means to position the respective governor valve means in predetermined proportionality with the desired turbine-generator power output signal at times when the corresponding intercept valve means is not fully opened, and responsive to the desired and detected turbine power output signals at times when the intercept valve means is fully opened to position the governor valve means to vary the steam flow through the turbine to reduce a difference between the detected and desired turbine power output signals.

40. A control system according to claim 39 wherein one half the desired minimum steam flow passes through a high pressure turbine and its corresponding intermediate-low pressure turbine when the associated intercept valve means is fully opened, the associated bypass valve means being closed at desired turbine-generator power output levels that exceed that power output level corresponding to passage of one half the desired minimum steam flow through the high pressure and the intermediate-low pressure turbines.

* * * * *